US006292155B1

(12) United States Patent
McPhilmy et al.

(10) Patent No.: US 6,292,155 B1
(45) Date of Patent: Sep. 18, 2001

(54) SYSTEM AND METHOD FOR RESTORING PERFORMANCE TO A WEATHERED SATELLITE TERMINAL

(75) Inventors: Steven McPhilmy, Frederick; Jack Lundstadt, Monrovia, both of MD (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/664,162

(22) Filed: Sep. 18, 2000

Related U.S. Application Data

(60) Provisional application No. 60/199,437, filed on Apr. 25, 2000.

(51) Int. Cl.[7] ..... H01Q 1/42
(52) U.S. Cl. ..... 343/872; 343/873
(58) Field of Search ..... 343/872, 873, 343/840; H01Q 1/42

(56) References Cited

U.S. PATENT DOCUMENTS 5,344,685 * 9/1994 Cassell ..... 343/872
5,729,241 * 3/1998 Ergen et al. ..... 343/872
6,211,843 * 4/2001 Antipov et al. ..... 343/872

* cited by examiner

*Primary Examiner*—Hoanganh Le
(74) *Attorney, Agent, or Firm*—John T. Whelan; Michael W. Sales

(57) ABSTRACT

A protective coating for reflectors and a feed of a satellite terminal. The protective coating includes a multiplicity of removable sheets that can be removably attached to any of the reflective surfaces of the reflectors or to the transmitting or receiving surface of the feed, which can be referred to as the critical surfaces of the satellite terminal. The sheets can be removed one at a time when the uppermost sheet becomes dirty. Each sheet includes a substrate layer made of a suitable material such as mylar or polyester, a metallic layer on top of the substrate layer that can be, for example, specular aluminum or silver, an ultraviolet stable hydrophobic layer, such as acrylic, on top of the metallic layer, and a mild adhesive layer beneath the substrate layer allowing each sheet to be removed from the remaining sheets. The bottom sheet is attached to one or more of the critical surfaces of the satellite terminal and has a thermal coefficient of expansion substantially equal to that of the critical surface to which it is attached. The protective coating can cover either the entire reflective surface of each reflector of the satellite terminal, or only a portion of each reflective surface. Each sheet can be removed by hand without special tools.

26 Claims, 7 Drawing Sheets

SYSTEM AND METHOD FOR RESTORING PERFORMANCE TO A WEATHERED SATELLITE TERMINAL

SYSTEM AND METHOD FOR RESTORING PERFORMANCE TO A WEATHERED SATELLITE TERMINAL

The present invention claims benefit under 35 U.S.C. § 119(*e*) of a U.S. provisional application of Steven McPhilmy and Jack Lundstadt entitled "Field Renewable Reflector & Hydrophobic Films for VSAT Antenna System", Ser. No. 60/199,437, filed Apr. 25, 2000, the entire contents of which is incorporated herein by reference.

BACKGROUND OF THE INVENTION

1. Field of the Invention

The present invention relates to a removable protective coating for a satellite terminal, such as a very small aperture terminal (VSAT) satellite terminal. More particularly, the present invention relates to a system and method employing a layered protective coating which can be applied to a reflector, sub-reflector, and feed horn of a satellite terminal to protect the original surfaces of those components, and whose outermost layer can be removed as desired to expose an underlying layer, which thus essentially restores the exposed surface of the coating to an "as new" condition without harming the satellite terminal components, and thereby restores optimum reception quality of the satellite terminal.

2. Description of the Related Art

The quality of reception of a satellite terminal, such as a VSAT satellite terminal, depends on the cleanliness and dryness of the surface of the concave portion of the main reflector of the VSAT satellite terminal, as well as the surfaces of the sub-reflector and the feed horn (hereinafter "critical surfaces"). As a satellite terminal is being used, it eventually becomes more and more dirty as dust and bird droppings accumulate on the bottom portion of the concave portion of the main reflector, as well as on the sub-reflector and the feed horn. As this accumulation of dirt and debris occurs, the reception quality of the VSAT satellite terminal deteriorates. In addition, the quality of reception depends upon the effectiveness of the hydrophobic coating used to repel and minimize water and condensation build-up. These coatings generally degrade with ultra violet exposure. Therefore, these critical surfaces of the VSAT satellite terminals must be cleaned periodically in order to restore reception quality.

Earlier forms of cleaning the critical surfaces of a VSAT satellite terminal require specialized tools, such as spray washers or aerosol sprays and cleaning utensils such as cloths, brushes and the like. These methods of cleaning are complex and labor intensive. They may also cause damage to the surfaces, thus permanently destroying quality of reception. What is needed is a simple, quick and easy way to restore the cleanliness and reception of a VSAT satellite terminal.

SUMMARY OF THE INVENTION

It is therefore an object of the present invention to provide a simple means for restoring the cleanliness and performance of the critical surfaces of a satellite terminal, such as the main reflector, the sub-reflector, and the feed horn of a VSAT satellite terminal, to an "as new" condition when the surfaces become dirty, begin to exhibit hydrophilic properties, or when the surfaces have been exposed to excessive ultra-violet radiation.

It is also an object to provide a simple and easy means of restoring the hydrophobic properties of the critical surfaces of a satellite terminal when those surfaces begin to absorb or adsorb water.

It is yet another object to provide a simple and easy means of restoring the ultra violet protection to the critical surfaces of a VSAT satellite terminal when the ultra violet screening to the satellite terminal deteriorates.

It is still yet another object to provide a simple and easy means for restoring the quality of signal reception of a VSAT satellite terminal that is not harmful to the satellite terminal and that is compatible with the satellite terminal.

These and other objects can be substantially achieved by providing a satellite terminal that contains a multiplicity of removable sheets on its critical surfaces that can be removed one at a time when the critical surfaces of the satellite terminal become dirty. Each sheet comprises a substrate layer made of, for example, either mylar or polyester, a metallic layer on top of the substrate layer that can be, for example, either specular aluminum or silver, an ultraviolet stable hydrophobic layer such as acrylic on top of the metallic layer, and a mild adhesive layer beneath the substrate layer allowing each sheet to be removed from the remaining sheets. The bottom sheet is bonded to a critical surface on a satellite antenna receiver and has a thermal coefficient of expansion substantially equivalent to that of the critical surface, such as aluminum. In one embodiment, the multiplicity of sheets covers the entire concave surface of the main reflector of a satellite terminal, in another embodiment, the multiplicity of sheets covers only the bottom portion of the concave surface of the main reflector of a satellite terminal where dirt is likely to accumulate. In a third embodiment, another multiplicity of sheets covers the surface of a sub-reflector, and in a fourth embodiment, a further multiplicity of sheets covers the exposed surface of the feed horn. Each sheet has at least one tab and, if desired, at least one opening which enables it to be easily removed by hand without special tools.

BRIEF DESCRIPTION OF THE DRAWINGS

These and other objects, advantages and novel features of the invention will be more readily appreciated from the following detailed description when read in conjunction with the accompanying drawings, in which.

DETAILED DESCRIPTION OF THE PREFERRED EMBODIMENTS

Figure 1:
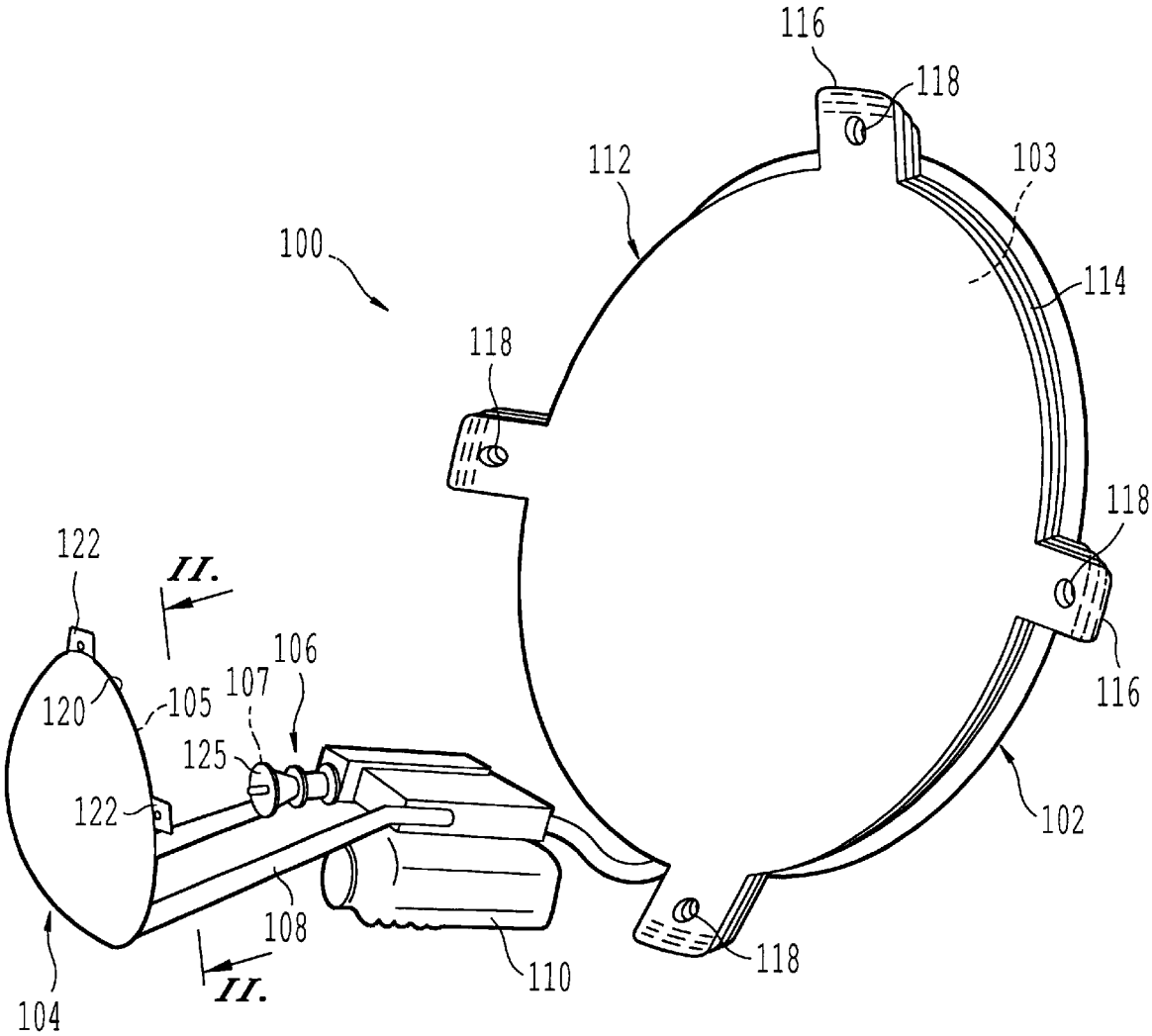
FIG. 1 illustrates a VSAT satellite terminal according to the principles of an embodiment of the present invention, in which the critical surfaces of the main reflector, sub-reflector and feed horn are covered by layered protective, removable sheets.

FIG. 1 illustrates a satellite terminal 100, such as a very small aperture terminal (VSAT) with which a removable protective coating according to an embodiment of the present invention is adapted for use. Communication signals in the form of, for example, electromagnetic radiation are transmitted from an extraterrestrial satellite (not shown), such as a geosynchronous earth orbit (GEO) satellite or a low earth orbit (LEO) satellite and are received first by main reflector 102.

Main reflector 102 has a concave surface 103 that can be made of aluminum or some other material that reflects electromagnetic radiation in such a manner that the beams of electromagnetic radiation are either collimated or partially collimated. Sub-reflector 104 faces main reflector 102 and receives the collimated or partially collimated beams reflected off of main reflector 102. These beams are again reflected off the concave surface 105 of sub-reflector 104, and are directed into a feed 106, such as a feed horn, having a signal receiving and/or emitting surface 107. A bracket 108 connects the sub-reflector and feed 106 to main reflector 102. When the signals are received by feed 106, the signals are then fed into, for example, a transceiver 110 for processing.

As can further be appreciated from FIG. 1, the satellite terminal 100 can operate as a transmitter in which communication signals in the form of, for example, electromagnetic radiation are emitted from feed horn 106, reflected off of sub-reflector 104 onto main reflector 102, which in turn reflects the signals in a pointing direction toward space to be received by a satellite (not shown). As mentioned above, the signal emitting and receiving surface 107 of the feed 106, and the surfaces of the sub-reflector 104 and main reflector 102 that reflect signals are referred to herein as the "critical surfaces".

As further illustrated in FIG. 1, a multi-layered protective coating 112 covers the reflective surface 103 of main reflector 102. The coating 112 comprises a multiplicity of disposable sheets 114 that protect the critical surfaces from the collection of dust, dirt, and other debris such as bird droppings and the like. That is, because satellite terminal 100 is in an outdoor environment, receiver 100 is prone to become dirty from the elements over a long period of time. This dust, dirt, debris and bird droppings, if allowed to accumulate, would result in deteriorated performance of satellite terminal 100. As a result, multiplicity of disposable sheets 114 are located over the concave surface of main reflector 102, the concave surface of sub-reflector 104, and over the feed 106.

When any one of the critical surfaces becomes dirty, thus resulting in degraded performance, the top sheet 114 can be removed to restore satellite terminal 100 to an "as new" condition. Convenient tabs 116 located at the circumference of sheets 114 allow a user to easily remove one sheet at a time. As further shown, tabs 116 can have openings 118 therein, if desired, to facilitate removal of the sheets 114.

Figure 2:
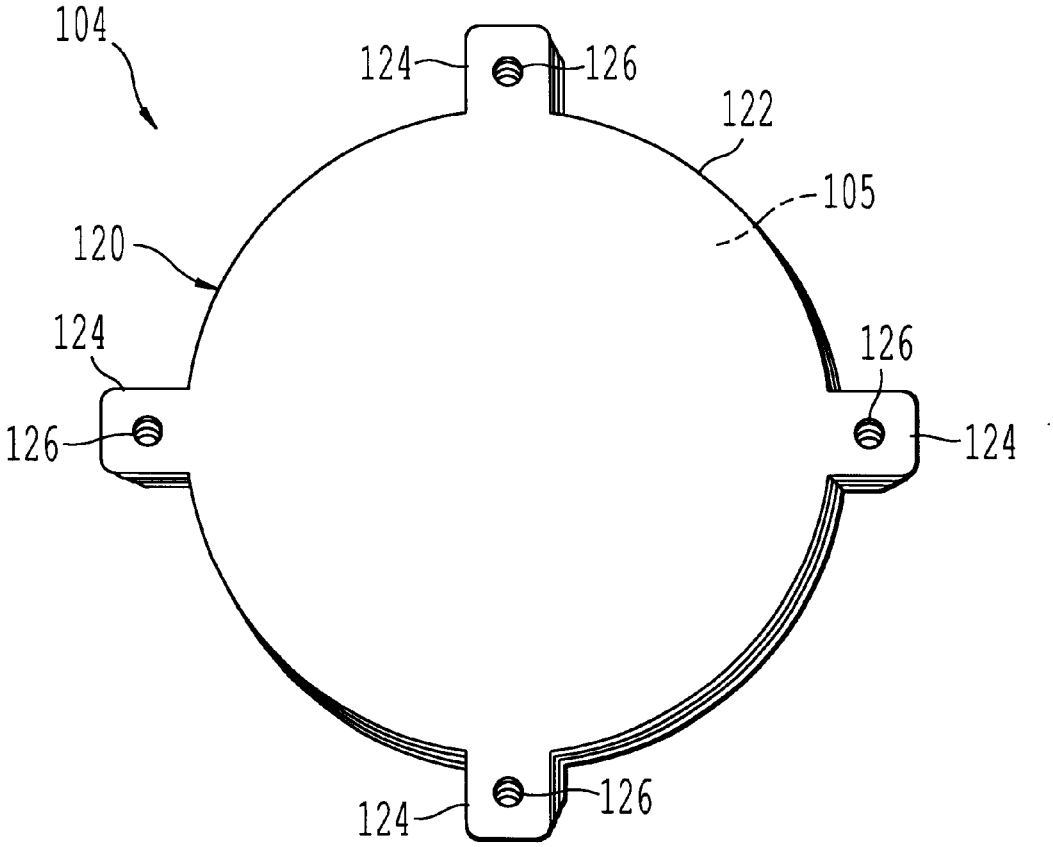
FIG. 2 illustrates a cross section of a satellite receiver of FIG. 1 showing protective, removable sheets covering the sub-reflector according to an embodiment of the present invention.

FIG. 2 illustrates a cross-sectional view taken along lines 2—2 in FIG. 1 to show the concave surface 105 of sub-reflector 104. As with main reflector 102, the concave surface 105 of sub-reflector 104 is made of a material that reflects electromagnetic radiation, such as aluminum. This reflective surface 105 is also covered by a protective coating 120 which, like protective coating 112, comprises a plurality of removable, disposable sheets 122. Because sub-reflector 104 is used in an outdoor setting, the sub-reflector 104, like main reflector 102, can collect a significant amount of dust, dirt, debris, and bird droppings over an extended period of time. This accumulation of dirt will eventually degrade the performance of satellite terminal 100.

According to the principles of this embodiment of the invention, the performance of satellite terminal 100 can be restored and the dirt can be removed easily by simply removing the uppermost sheet 122. This is easily accomplished by pulling on one or more of the tabs 124 located on the circumference of each sheet 122. As with tabs 116 of the sheets 114 shown in FIG. 1, each tab 124 can include an opening 126 therein to enable a person to better grip the tab 124 and thus more easily remove the sheet 122. After removing top sheet 122, sub-reflector 104 is free from dust, dirt, debris, and bird droppings, making satellite terminal 100 restored to an "as new" condition. The critical surface 107 of feed 106 is covered with a layered protective coating 125 similar to coatings 112 and 120 described above, and can thus be kept free from contamination that inhibits performance of antenna 100.

Figure 3:
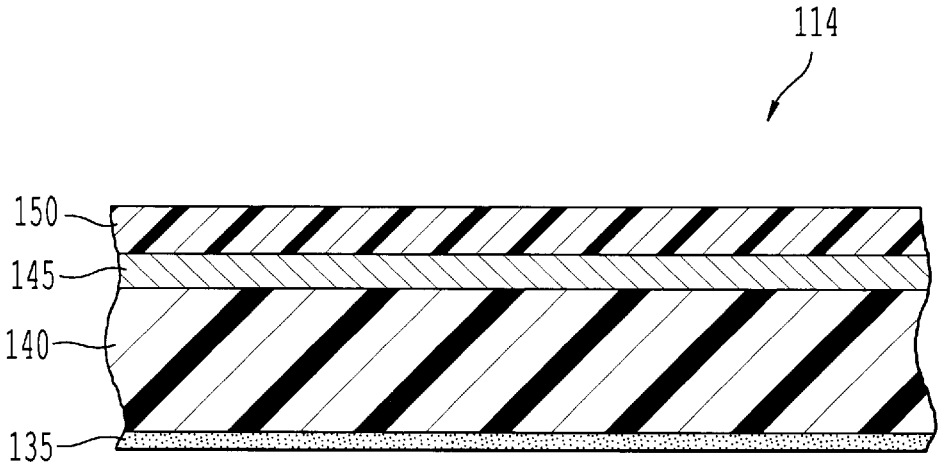
FIG. 3 illustrates a cross section of an individual sheet showing its detailed composition according to the principles of an embodiment of the present invention.

The details of a removable sheet, such as a sheet 114 or 122 are shown in FIG. 3. For exemplary purposes, FIG. 3 illustrates an exemplary cross-section of a sheet 114. It should be noted that the cross-section of sheet 114 is identical to the cross section of each of the sheets found on either main reflector 102 or sub-reflector 104. However, as can be appreciated by one skilled in the art, the sheets of the protective coating 125 covering the feed 106 do not contain the metallic layer 145 described below so that the protective coating 125 covering the feed 106 can be transparent to the electromagnetic (EM) signal being transmitted from or received by the feed 106. Also, the thicknesses shown in FIG. 3 are not to scale, but illustrate that certain layers are thicker than others.

Layer 135 illustrated in FIG. 3 is an adhesive layer. Adhesive layer 135 has a typical thickness of about 800 nm, but can have any suitable thickness Adhesive layer 135 is also mild enough to allow a user to remove sheet 114 from the remaining sheets 114 by pulling on one or more of the tabs 116 located about its circumference as shown in FIG. 1. Contacting adhesive layer 135 is substrate layer 140. Substrate layer 140 provides for most of the bulk of sheet 114. Substrate 140 layer can be about 5 mm thick, or have any other suitable thickness, and is made out of polyester, mylar, or any other suitable material.

Adjacent to substrate layer 140 is a metallic layer 145. Metallic layer 145 is made out of either aluminum or silver in this example, but can be made from any other suitable material. Metallic layer 145 is relatively thin, having a thickness of approximately 50 nm in this example, or any other suitable thickness. Lastly, adjacent metallic layer 145 is hydrophobic layer 150. Hydrophobic layer 150 is ultra violet stable and can be made of acrylic or any other suitable material. The thickness of hydrophobic layer 150 in this example is about 80 nm, but can be any other suitable thickness.

It is noted that sheets 114 can be acquired commercially from 3M Corporation under the product name SA 85. SA 85 consists of a 2.0 mil thick polyester substrate coated with specular aluminum having a thickness of about 500 Angstroms, and sealed with a hydrophobic and UV stable acrylic compound. SA 85 is vacuum formable and can be manufactured such that the bottom sheet has a thermal coefficient of expansion equal or equivalent to that of the critical surface of main reflector 102, sub-reflector 104, or feed 106, which are usually made out of aluminum.

Figure 4:
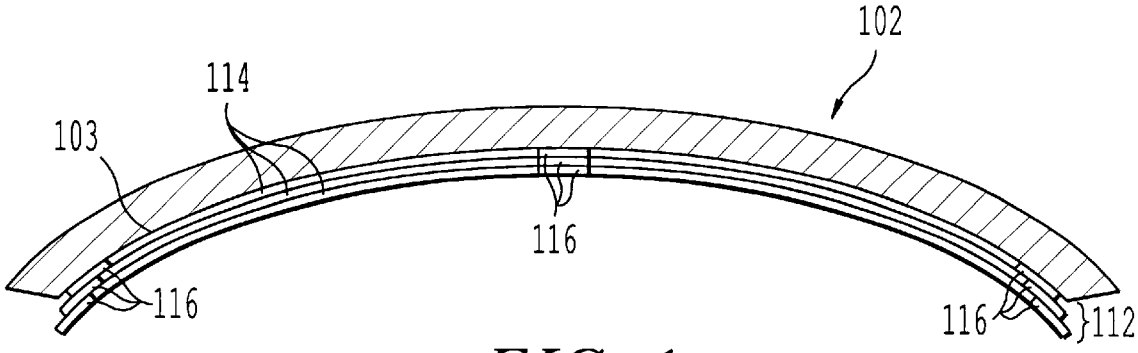
FIG. 4 is a cross-sectional view of the edges of the protective sheets and main reflector as shown in FIG. 1.

FIG. 4 is a cross-sectional view of a critical surface to which coating 112 having a plurality of sheets 114 is attached. The critical surface shown is surface 103 of main reflector 102, but may be also be that of sub-reflector 104, or feed 106. The surface may be a metallic surface such as aluminum. It is noted that the tabs 116 are located at various places along the edge of each sheet 114. The tabs 116 are progressively offset, with the tabs 116 of the uppermost sheet 114 extending beyond tabs 116 of the lower sheets 114, thus allowing a user to easily access the tabs of a single sheet at one time in order to remove only a single sheet 114.

Figure 5:
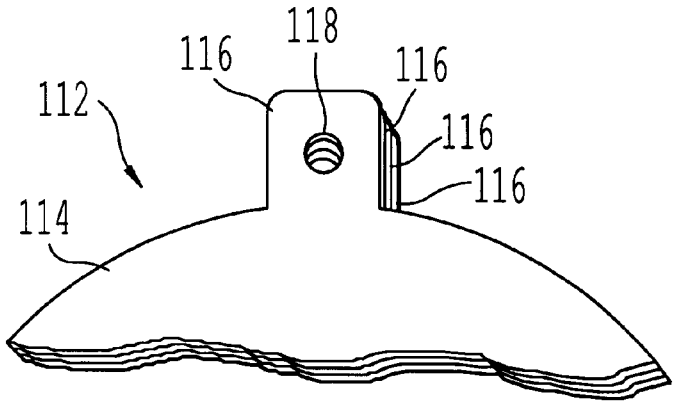
FIG. 5 is a detailed view of the tab portions of the protective sheets according to the principles of the present invention.

FIG. 5 illustrates a close up of the tabs 116 of the sheets 114. Each tab 116 is integral with or attached to the circular portion of its respective sheet 114. When the top sheet 114 needs to be removed and disposed of, one or more tabs 116 of the top sheet are folded and pulled, thus aiding in the removal of the uppermost sheet 114.

Figure 6:
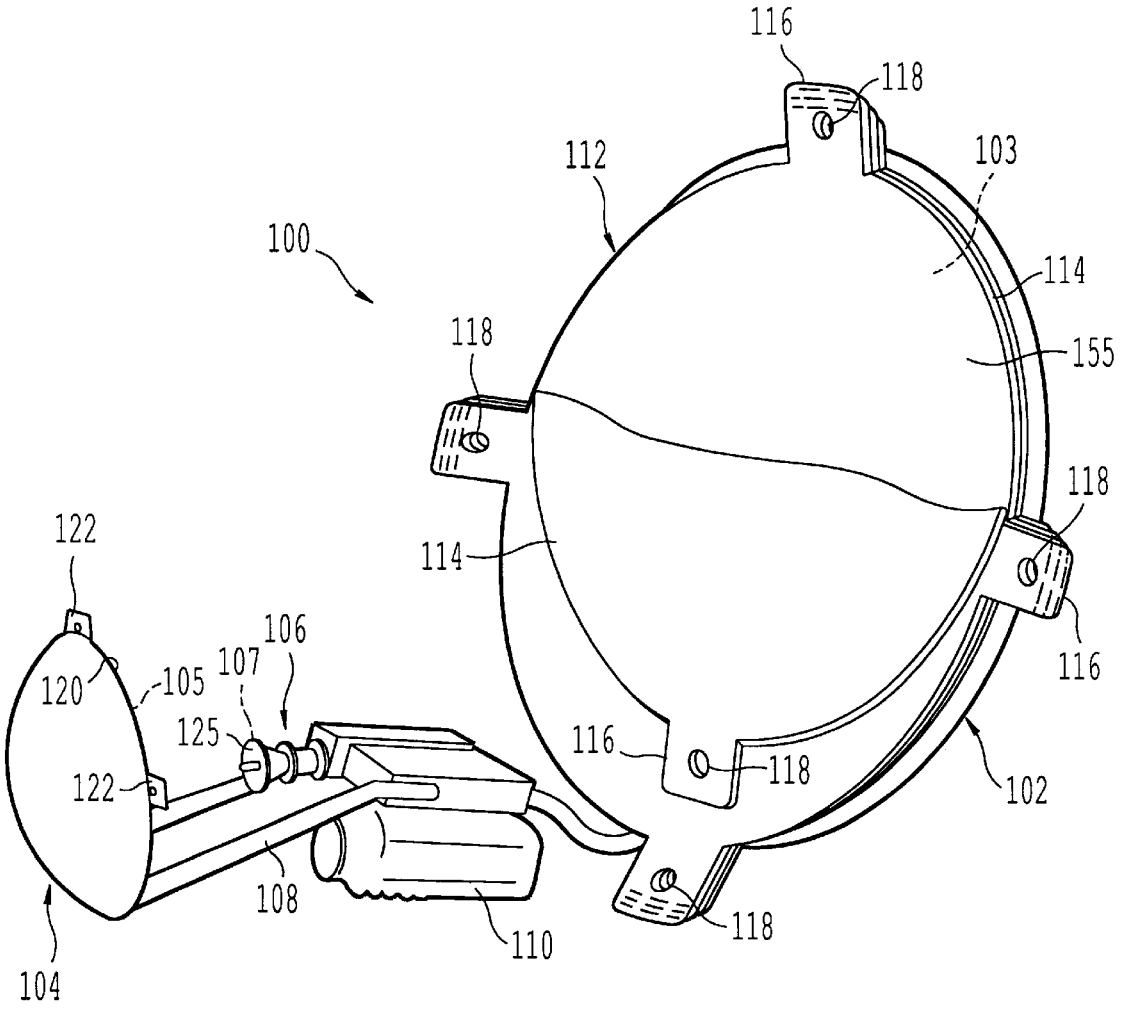
FIG. 6 illustrates the removal of a top sheet from the main reflector of the satellite receiver shown in FIG. 1 according to the principles of the present invention.

FIG. 6 further illustrates an embodiment of the present invention where sheets 114 cover the entire surface of concave main reflector 112. In this embodiment, top sheet 114 is being peeled off from the remainder of sheets 114. During this sheet removal process, top sheet 114 is removed so that the clean surface of the next sheet 114 is exposed. Typical maintenance of this sheet removal process generally occurs once a year, but can be done at any desired time. After the process is complete, the dirt from top sheet 114 is disposed of while a new, clean surface 155 of the underlying sheet 114 is exposed allowing for performance of satellite terminal 100 to be restored as new. A similar process can be achieved on surface 114 of sub-reflector 114 and on feed horn 106. Thus, the need for aerosols, sprays, cloths, and scrubbers is eliminated.

Figure 7:
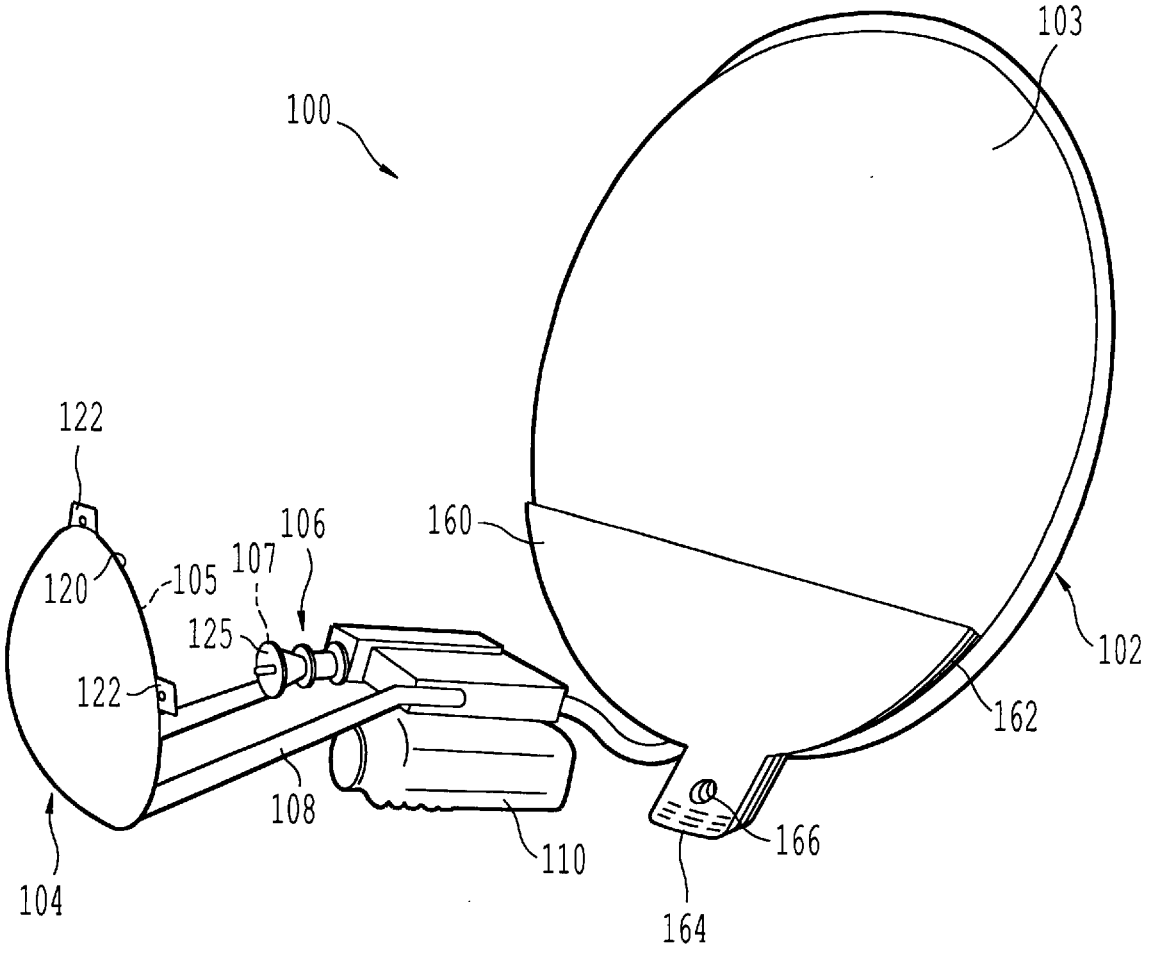
FIG. 7 illustrates the layered protective removable sheets partially covering of the main reflector according to another embodiment of the present invention.

FIG. 7 illustrates a second embodiment of the present invention. In FIG. 7, main reflector 102 of satellite terminal 100 is only partially covered with the coating 160 comprising thin, removable sheets 162, which are similar to coating 112 and sheets 114 described above. The portion that is covered is the bottom portion of the concave surface 103, which is a region where dust, dirt, debris, and bird droppings typically accumulate. Meanwhile, top portion of main reflector 102 has the bare aluminum surface 103 always exposed to the elements. In this embodiment, at least one set of tabs 164 are present on the bottom of the sheets 162. As with tabs 116 described above, tabs 164 can include openings 166 similar to openings 118.

The uppermost sheet 162 is removed from the remainder of sheets 162 when the bottom portion of the concave portion of main reflector 102 becomes dirty as described above. This is accomplished by pulling the top tab of top sheet 162 to remove and dispose of top sheet 162 leaving behind an exposed clean surface of the underlying sheet 162, thus restoring reception quality of the satellite terminal 100 to an "as new" condition. Note again that tabs 164 are progressively layered enabling a user to easily grasp the top tab without encountering difficulty separating the top tab from the underlying tabs.

Figure 8:
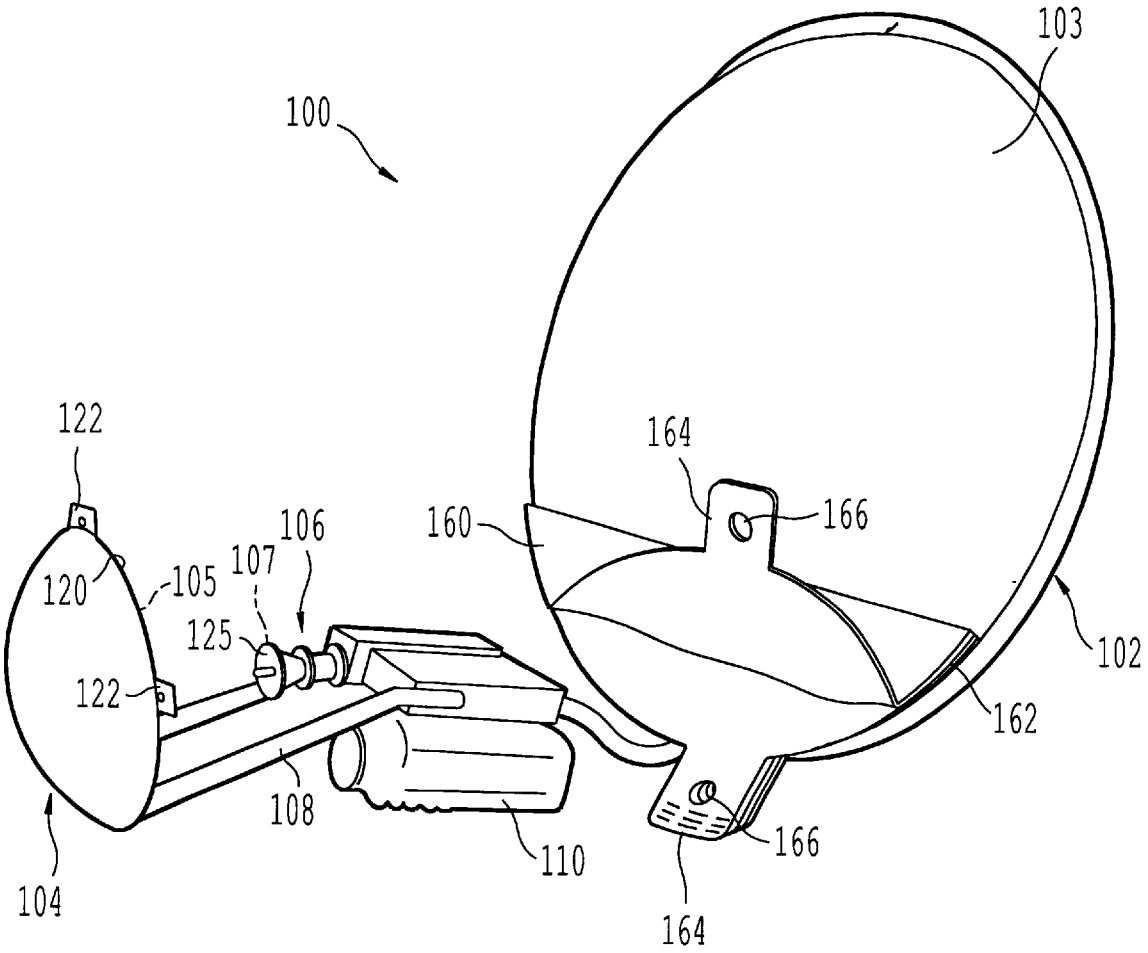
FIG. 8 illustrates the removal of a top sheet as shown in FIG. 7 according to an embodiment of the present invention.

FIG. 8 illustrates the film removal process according to the second embodiment of the present invention. As discussed with regard to FIG. 7, satellite terminal 100 has main reflector 102 which is only partially covered by coating 160 comprising thin sheets 162, thus leaving the top portion of concave surface 103 permanently exposed to the elements. In FIG. 8, top sheet 162, which has become soiled and weathered, is removed in a manner as described above, thus exposing the clean surface of a new, underlying sheet 162. This process is accomplished by pulling on one or more tab 164 of top sheet 162 and removing top sheet 162 from the underlying sheets. Top sheet 162 is then disposed of and satellite terminal 100 has its reception quality restored to as new. Over time, weather, dust, debris, and bird droppings will again accumulate and the next layer underneath will eventually have to be removed.

Figure 9:
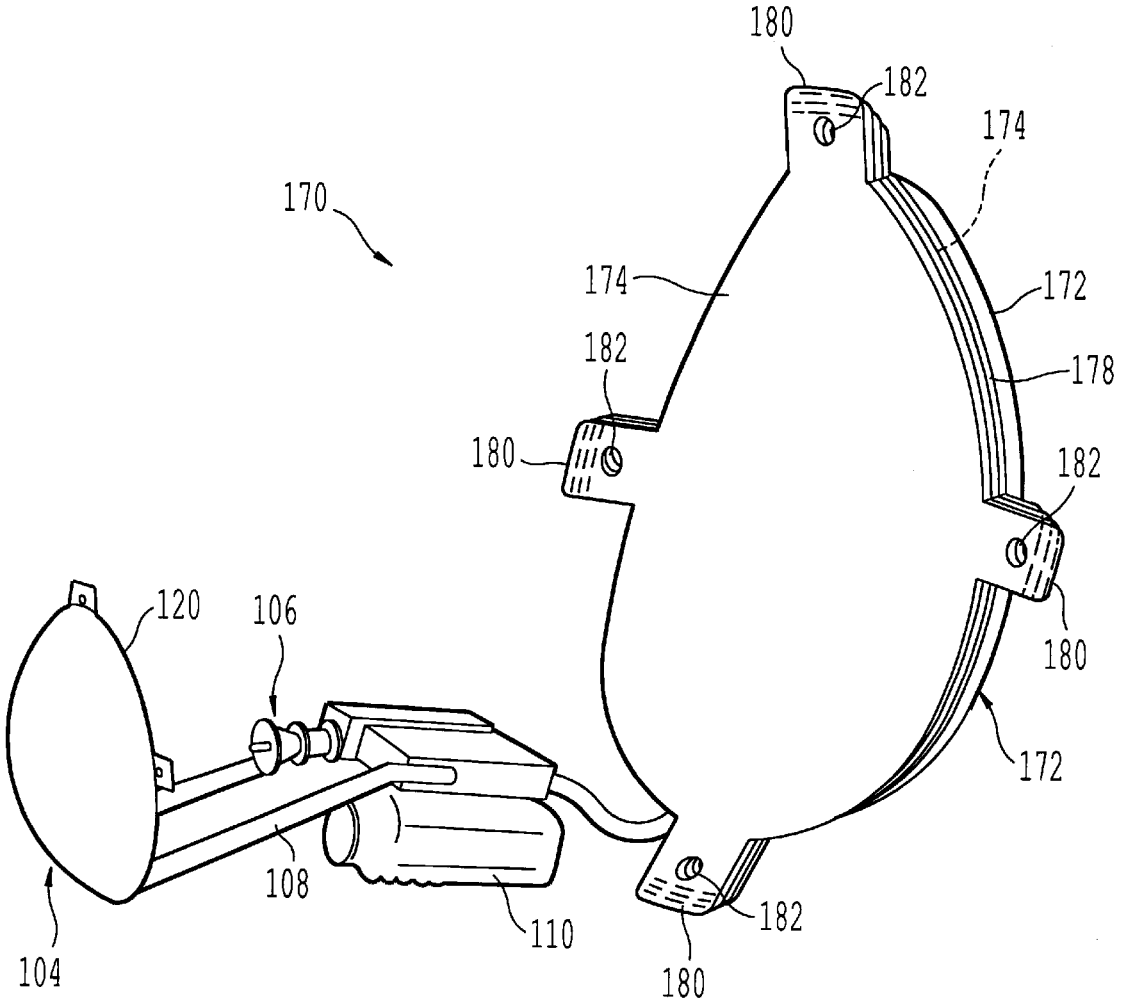
FIG. 9 illustrates protective layered removable sheets according to another embodiment of the present invention, disposed on a main reflector having a geometric shape other than circular.

FIG. 9 illustrates a third embodiment of the present invention. In this embodiment, satellite terminal 170 has main reflector 172 which, unlike main reflector 102 described above, has an oval or other non-round shape. Satellite terminal 170 further includes a sub-reflector 104, feed 106, bracket 108 and transceiver 110 as described above. Like main reflector 102, main reflector 172 has a reflective surface 174 made of a material such as aluminum. A protective coating 176 having a multiplicity of sheets 178 cover the reflective surface of main reflector 172. The coating 176 and sheets 178 are similar to coating 112 and sheets 114 described above. However, the coating 112 is shaped in accordance with the shape of the surface 174 of main reflector 172. Also, each sheet has tabs 180 that are progressively layered to allow easy removal of individual sheets. The tabs 180 are similar to tabs 116 described above, and can have openings 182 similar to openings 118 described above.

As can be appreciated by one skilled in the art, the main reflector 102 or 172, sub-reflector 104 and surface of feed 106 can have any suitable geometric shape, such as elliptic, or hyperbolic. In each case, a protective coating such as those described above having thin sheets cover the critical surfaces of the main reflector, sub-reflector and feed. When the top sheet becomes soiled or weathered, the top sheet is removed by using the tabs to expose an underlying clean sheet restoring antenna receiver to an "as new" condition.

While the preferred embodiment has been set forth with a degree of particularity, it is to be understood that changes and modifications could be made to the construction thereof which would still fall within the teachings of the claimed invention as set forth in the following claims.

What is claimed is:

1. A protective coating, adapted for use with a satellite terminal, said protective coating comprising:

a plurality of sheets stacked on top of one another and bonded to each other by an adhesive, each of said plurality of sheets comprising a hydrophobic coating;

an uppermost sheet of said plurality of sheets being removable from remaining ones of said plurality of sheets, and a lowermost sheet being adapted for attachment to a reflecting surface of a main reflector, a reflecting surface of a sub-reflector, or a surface of a feed element of said satellite terminal.

2. The protective coating of claim 1, wherein said protective coating is adapted for attachment to said reflecting surface of said main reflector.

3. The protective coating of claim 1, wherein said protective coating is adapted for attachment to said reflecting surface of said sub-reflector.

4. The protective coating of claim 1, wherein said protective coating is adapted for attachment to a surface of said feed element through which signals are received by or transmitted from said feed element.

5. The protective coating of claim 1, wherein each of said plurality of sheets comprises a metallic layer at least partially covered by a hydrophobic coating.

6. The protective coating of claim 5, wherein each of said plurality of sheets further comprises a substrate layer adjacent to said metallic layer.

7. The protective coating of claim 6, wherein said substrate layer includes mylar.

8. The protective coating of claim 6, wherein said substrate layer includes polyester.

9. The protective coating of claim 5, wherein said metallic layer includes aluminum.

10. The protective coating of claim 5, wherein said metallic layer includes silver.

11. The protective coating of claim 1, wherein said lowermost sheet has a thermal expansion coefficient substantially equal to a thermal expansion coefficient of said reflecting surface of said main reflector, said reflecting surface of said sub-reflector, or said surface of said feed element of said satellite terminal.

12. The protective coating of claim 1, wherein said hydrophobic coating includes acrylic.

13. A satellite terminal, comprising:

a first reflector having a first reflecting surface adapted to reflect first signals received from a satellite or reflect second signals toward said satellite; and a first protective coating attached to at least a portion surface of said first reflector, said first protective coating comprises a plurality of sequentially layered first removable sheets.

14. The satellite terminal of claim 13, further comprising:

a second reflector having a second reflecting surface, adapted to reflect said first signals, which are reflected onto said second reflecting surface from said first receiving surface, or to reflect said second signals toward said first reflecting surface; and a second protective coating attached to at least a portion of said second reflecting surface of said second reflector, said second protective coating comprising a plurality of sequentially layered second removable sheets.

15. The satellite terminal of claim 13, further comprising:

a feed having a feed surface, adapted to receive said first signals reflected onto said feed surface from said second receiving surface, or to transmit said second signals toward said second reflecting surface; and a third protective coating attached to at least a portion of said feed surface, said second protective coating comprising a plurality of sequentially layered third removable sheets.

16. The satellite terminal of claim 13, wherein at least one of said plurality of first removable sheets comprises:

a substrate layer;

a metallic layer attached to said substrate layer;

a hydrophobic coating covering at least a portion of said metallic layer; and an adhesive on a side of said substrate layer opposite to that upon which said metallic layer is attached.

17. The satellite terminal of claim 16, wherein said substrate layer includes at least one of mylar and polyester.

18. The satellite terminal of claim 16, wherein said metallic layer includes at least one of aluminum and silver.

19. The satellite terminal of claim 16, wherein said hydrophobic layer includes acrylic.

20. The satellite terminal of claim 13, wherein the one of said plurality of first sheets attached to said first reflecting surface has a thermal expansion coefficient substantially equal to a thermal expansion coefficient of said first reflecting surface.

21. A method for protecting a satellite terminal from contaminants, comprising the steps of:

providing a first protective coating comprising a plurality of sequentially layered first removable sheets; and removably attaching a lowermost one of said first removable sheets to at least a first portion of a first reflecting surface of a first reflector of said satellite terminal, to attach said first protective coating over said first portion.

22. The method as claimed in claim 21, further comprising the step of:

removing an uppermost one of said first removable sheets from a remainder of said plurality of first removable sheets of said first protective coating.

23. The method of claim 21, further comprising the steps of:

providing a second protective coating comprising a plurality of sequentially layered second removable sheets; and removably attaching a lowermost one of said second removable sheets to at least a second portion of a second reflecting surface of a second reflector of said satellite terminal, to attach said second protective coating over said second portion.

24. The method of claim 23, further comprising the steps of:

removing an uppermost one of said second removable sheets from a remainder of said plurality of second removable sheets of said second protective coating.

25. The method of claim 21, further comprising the steps of:

providing a third protective coating comprising a plurality of sequentially layered third removable sheets; and removably attaching a lowermost one of said third removable sheets to at least a third portion of a signal transmitting or receiving surface of a feed of said satellite terminal, to attach said third protective coating over said third portion.

26. The method of claim 25, further comprising the steps of:

removing an uppermost one of said third removable sheets from a remainder of said plurality of third removable sheets of said third protective coating.

* * * * *